United States Patent [19]

Parker et al.

[11] 4,218,586

[45] Aug. 19, 1980

[54] COMPATIBLE AM STEREO BROADCAST SYSTEM

[75] Inventors: Norman W. Parker, Wheaton; Francis H. Hilbert, Addison, both of Ill.

[73] Assignee: Motorola, Inc., Schaumburg, Ill.

[21] Appl. No.: 7,733

[22] Filed: Jan. 30, 1979

Related U.S. Application Data

[63] Continuation of Ser. No. 674,703, Apr. 7, 1976, abandoned.

[51] Int. Cl.[2] ..... H04H 5/00

[52] U.S. Cl. ..... 179/1 GS; 455/61; 455/91

[58] Field of Search ..... 325/36, 60, 61, 139; 179/15 BT, 15 BM, 16 B, 1 GS

[56] References Cited

U.S. PATENT DOCUMENTS

| | | | |
|---|---|---|---|
| 3,067,293 | 12/1962 | Moore | 179/1 GS |
| 3,068,475 | 12/1962 | Avins | 325/36 |
| 3,167,614 | 1/1965 | Holt et al. | 179/1 GS |
| 3,218,393 | 11/1965 | Kahn | 325/36 |
| 4,079,204 | 3/1978 | Takahashi et al. | 325/36 |

*Primary Examiner*—Marc E. Bookbinder
*Attorney, Agent, or Firm*—Margaret Marsh Parker; James W. Gillman

[57] ABSTRACT

A compatible AM stereo broadcasting system is disclosed in which the signal is a carrier having an amplitude directly variable with monoaural or sum (L+R) information, and having an instantaneous phase $\phi$ varying as a function of the resultant amplitude of the sum information (L+R) and difference information (L−R) which are established in a preselected phase relationship (quadrature). In a stereo receiver, L and R or the sum and difference signals may be restored by dividing the signal by the cosine of the angle $\phi$, and in a monaural receiver, the sum signal alone is detected.

38 Claims, 14 Drawing Figures

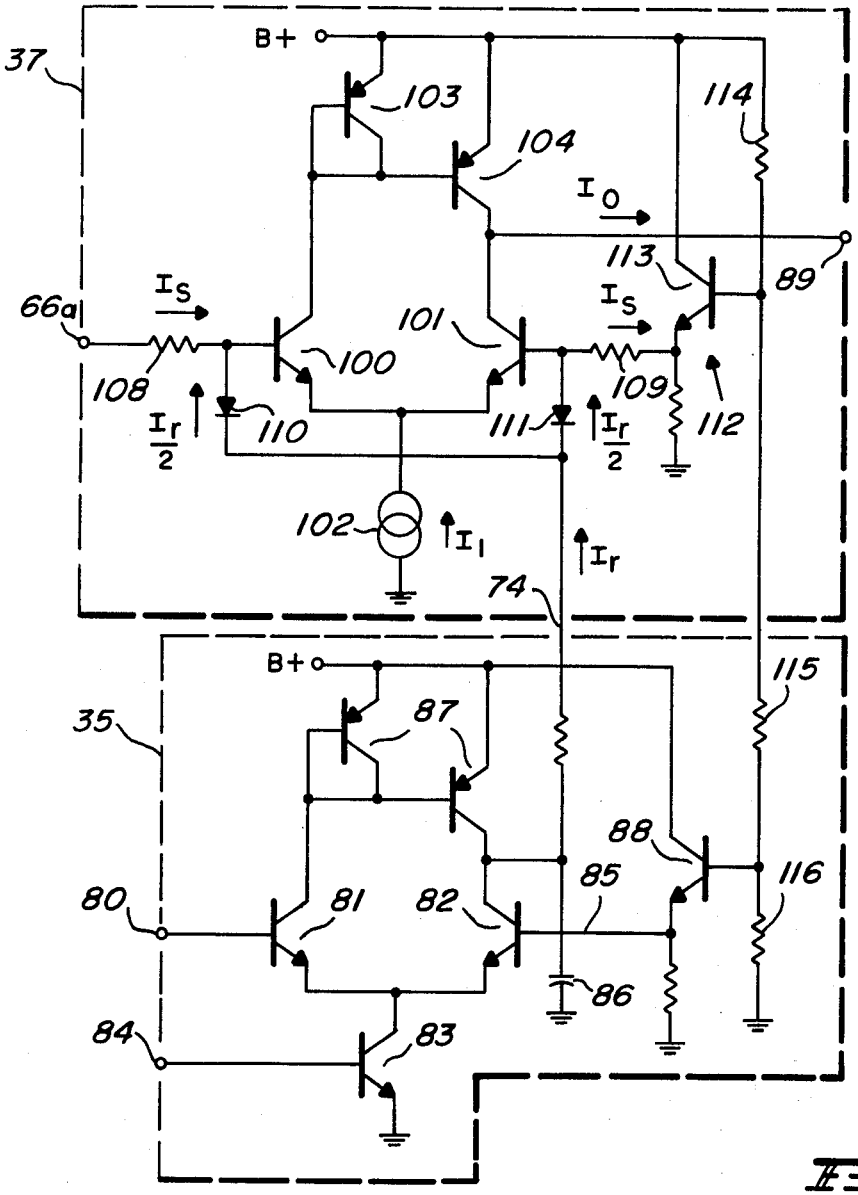
Fig. 7
Fig. 10
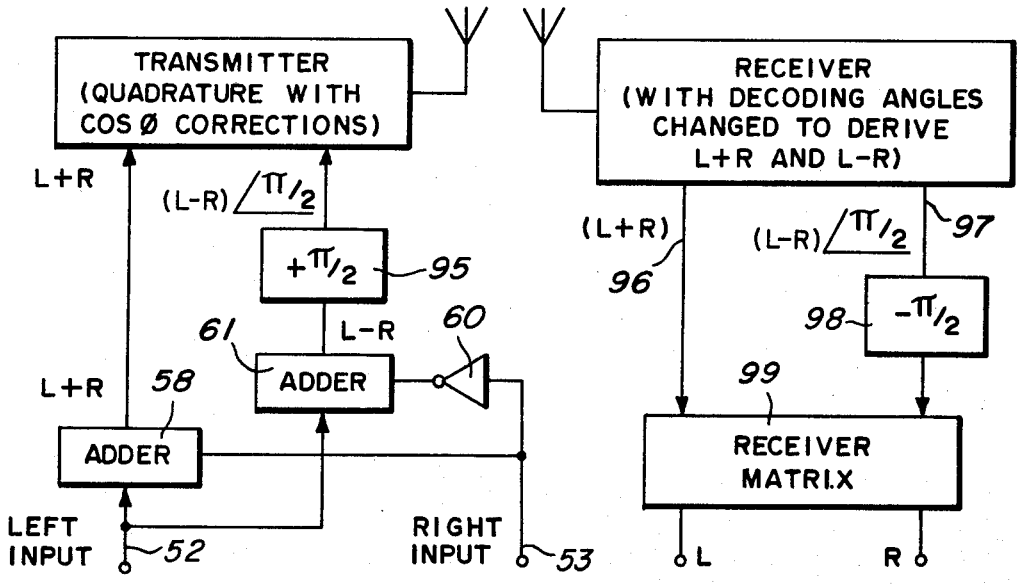

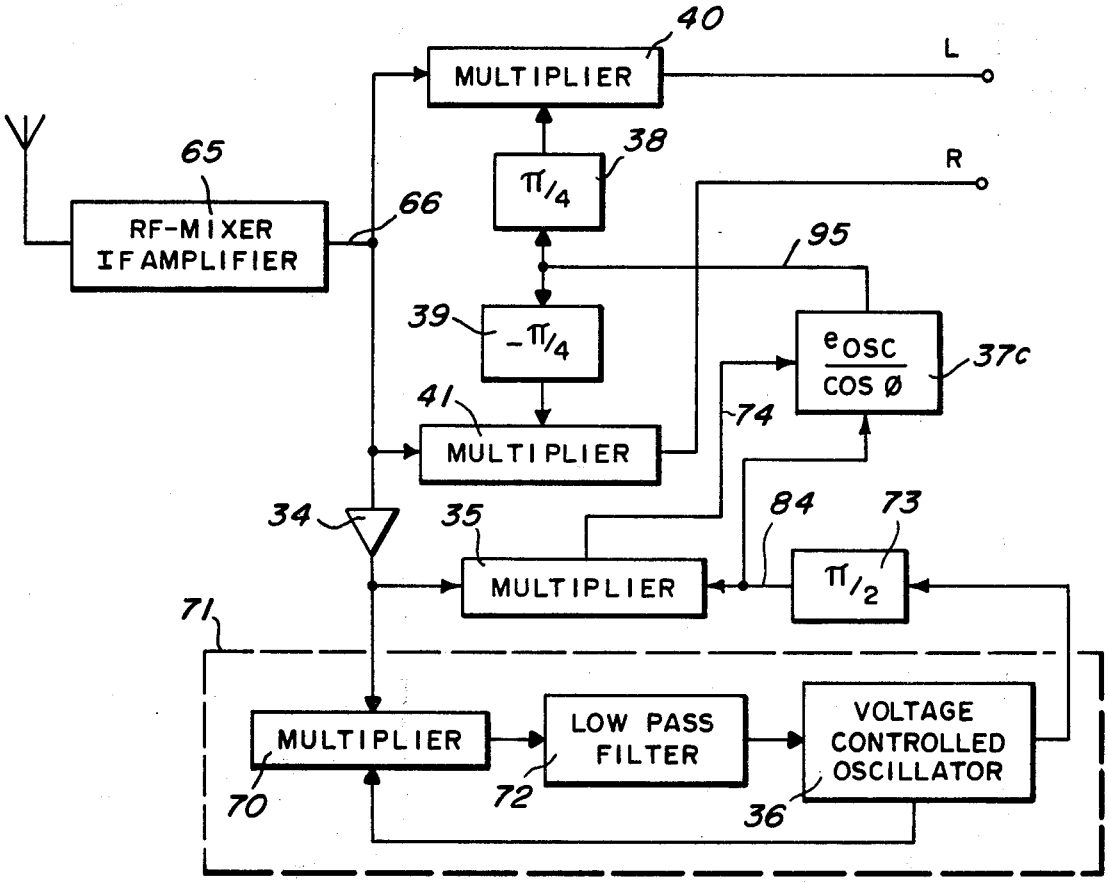
Fig. 9
Fig. 11
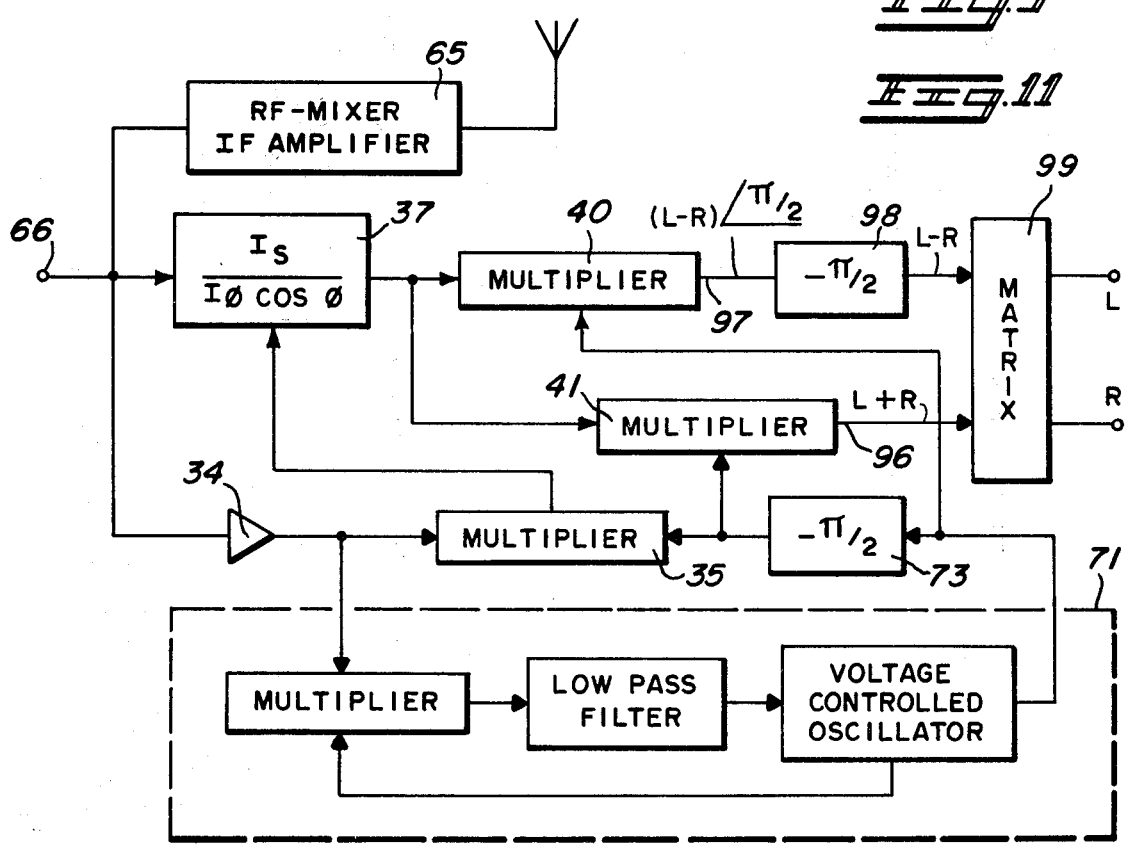

COMPATIBLE AM STEREO BROADCAST SYSTEM

This is a continuation, of application Ser. No. 674,703, filed Apr. 7, 1976, now abandoned.

BACKGROUND OF THE INVENTION

This invention relates to an AM stereo broadcast system for the transmission of two signals on a single carrier and more particularly to an improved system for transmitting and receiving fully compatible AM stereo signals on the AM broadcast band on monaural and stereo receivers without substantial distortion.

Several systems for transmitting and receiving AM stereo signals are known in the art. The simplest system is probably an unmodified quadrature signal which transmits two signals A, and B, e.g., left (L) and right (R), on two carriers which are identical in frequency but are in phase quadrature. This system is similar to the system used to transmit the two color signals on one carrier in the NTSC standard for U.S. color television transmission. On existing monaural receivers, using signal current rectifiers to derive the audio signal, however, there is double frequency distortion which is proportional to the amount of the stereo difference (L−R) signal. The distortion arises from the fact that this signal consists basically of the following:

$$\sqrt{(1+L+R)^2+(L-R)^2}\ \cos(\omega t+\phi)$$

where the term under the radical is the amplitude and where $\phi=\tan^{-1}(L-R)/(1+L+R)$. The monaural receiver, however, requires that the amplitude of the received signal be substantially the carrier plus the audio, or (1+L+R). The (L−R) term thus represents distortion, and,—since it is a squared term,—double frequency distortion. The $\phi$ term represents phase modulation and produces no output from a conventional envelope detector in a monaural receiver when there is no appreciable amplitude or phase distortion present on the signal in the entire system.

Still another prior system employs the technique of transmitting a single carrier, which is amplitude modulated with (L+R) information and frequency modulated with (L−R). The complex spectrum of the transmitted signal may give rise to undesirable distortion in both monaural and stereo receivers if any frequency or phase distortion is present in the received signal. When the (L−R) signal contains low frequency components, the radiated spectrum may contain many sideband frequencies which are subject to distortion in phase and amplitude which, in turn, produces spurious conversion of FM components to amplitude modulation.

Yet another system transmits sum and difference signals in quadrature, but distorts the (L+R) component to correct the amplitude of the envelope and make it compatible. This is done by changing the in-phase component from (1+L+R) to $$\sqrt{(1+L+R)^2-(L-R)^2}$$

and keeping the magnitude of the quadrature component unchanged. The phase or stereo information is thus distorted and the number of significant sidebands is increased, increasing the potential distortion on both monophonic and stereo receivers.

SUMMARY OF THE INVENTION

It is an object of the present invention to provide an AM stereo broadcast system which is compatible with existing AM monaural receivers.

It is a further object of the invention to provide a compatible stereo signal requiring minimal change in existing transmitters and minimal complication in receiver circuitry designed for stereo decoding.

The above objects are obtained according to the invention by a system wherein the transmitted signal includes both the monaural information and the phase or stereo information necessary for obtaining the separated stereo signals, but the monaural signal does not include the (L−R) or difference information. Thus, the signal is no different, to monaural circuitry, from a normal AM monaural transmission. In the transmitter, the required changes are minimal and for AM stereo receivers the circuitry is not complex. Basically, the concept involves multiplying the quadrature signal in the transmitter by a factor which is related to the phase of the stereo information, and in a stereo receiver dividing the received signal by the same factor, thus restoring the complete, original quadrature signal.

BRIEF DESCRIPTION OF THE DRAWING

FIG. 3 is a block diagram of an AM stereo system constructed in accordance with the present invention.

FIG. 7 is a circuit diagram of a portion of the receiver of FIG. 6.

FIG. 9 is a block diagram of still another preferred embodiment of the receiver.

FIG. 10 is a block diagram of a left-right SSB system.

FIG. 11 is a block diagram of a receiver for the system of FIG. 10.

DETAILED DESCRIPTION OF THE PREFERRED EMBODIMENTS

The AM quadrature system of the prior art (FIG. 1) and the compatible system constructed according to the present invention (FIG. 3) will, for the sake of brevity, be described in terms of a stereo signal having left (L) and right (R) program channels, nevertheless, it will be understood that there is nothing inherent in the system to so limit it and the system is applicable to the transmission and reception of any two signals on a single carrier.

Figure 1:
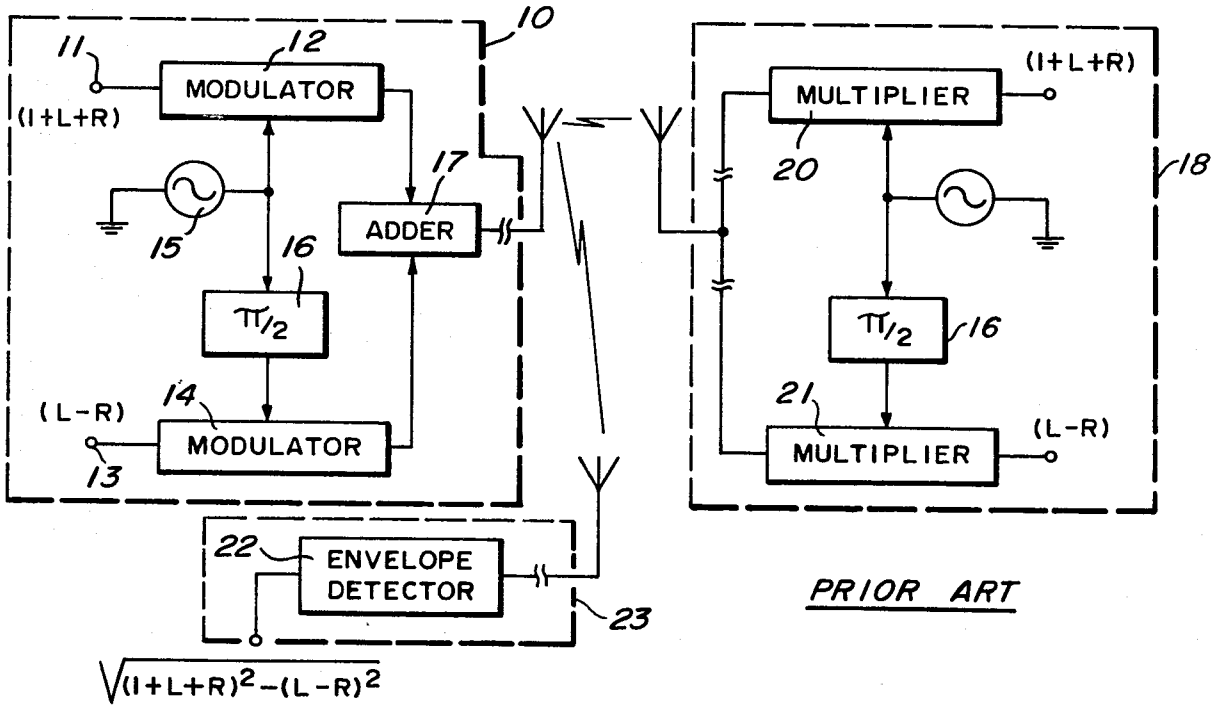
PRIOR ART FIG. 1
FIG. 1 is a block diagram illustrative of a prior art system for transmitting and receiving two signals amplitude modulated in quadrature on a single carrier.

The system according to the invention as shown in block form in FIG. 3 will be best understood in relation to the block diagram of FIG. 1 which is an unmodified and thus incompatible quadrature system. A quadrature transmitter, represented by a section 10 thereof, includes a program signal path from an input 11 which provides (1+L+R) to a modulator 12 and a second input 13 which provides (L−R) to a second modulator 14. An RF exciter 15 provides a carrier signal to the modulator 12 and, through a 90° phase shifter 16, to the modulator 14. The outputs of the two modulators are summed in signal adder 17 to provide a signal which is transmitted in the conventional fashion. This signal may be represented mathematically as $$\sqrt{(1+L+R)^2+(L-R)^2}\ \cos(\omega t+\phi)$$

where $\phi=\tan^{-}(L-R)/(1+L+R)$. When this signal is received by a stereo receiver, as represented by a section 18 thereof, and demodulated in product detectors or multipliers 20 and 21, the respective signals (1+L+R) and (L−R) are obtained. However, in the envelope detector 22 of a monaural receiver, indicated by dashed line 23, the demodulated output may be represented as $$\sqrt{(1+L+R)^2+(L-R)^2}$$

which it will be appreciated is compatible only for a signal wherein L=R, i.e. monophonic.

Figure 2:
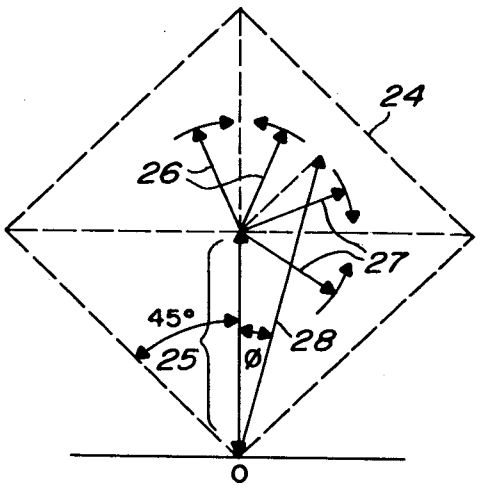
FIG. 2 is a phasor diagram representative of the carrier and sidebands of the transmitted signal in the system of FIG. 1.

The phasor diagram of FIG. 2 shows the locus 24 of the modulated transmitted signal for the system of FIG. 1. Phasor 25 represents the unmodulated carrier, 1 cos $\omega$ t, with the phasors 26 representing the in-phase modulating signal (L+R) and the phasors 27, the quadrature signal (L−R). $\phi$ indicates the instantaneous phase angle of a resultant phasor 28 which, as the locus 24 shows, cannot exceed ±45°.

A compatible AM stereo broadcast system in accordance with the invention is shown in block diagram form in FIG. 3. Again there are the two inputs 11' and 13', for (1+L+R) and (L−R), which are coupled to the two modulators 12' and 14' of a transmitter as partially shown by dashed line 30. The RF exciter 15' and the phase shifter 16' are as described in connection with FIG. 1. The outputs of the modulators 12' and 14' are summed in the adder 17'. Amplitude variations are then removed by a limiter 31, leaving only the phase information. The resulting phase modulated carrier may then be amplitude modulated by signal component (1+L+R) in a high level modulator or multiplier 32. The transmitted signal which may be represented as (1+L+R) cos ($\omega$t+$\phi$) is the equivalent of the original stereo signal from adder 17 multiplied by cos $\phi$ where $$(1+L+R)/\sqrt{(1+L+R)^2+(L-R)^2}\ .$$

The transmitted signal is completely compatible, i.e., when this signal is received by the monophonic receiver 23 and demodulated by the envelope detector 22, the output is proportional to (L+R). When the transmitted signal is received by a stereo receiver as indicated at 33, it is limited in limiter 34. The resulting stereo information is then compared in a multiplier stage 35 with the phase of cos $\omega$ t from a VCO 36 which is locked to the phase of the RF exciter 15 in the transmitter 30 in a manner to be described hereinafter. The phase difference is cos $\phi$ and the output of the multiplier 35 is proportional to cos $\phi$.

In a corrector circuit 37, which is further shown in FIG. 7 and will be described in detail hereinafter, the signal is divided by the output of the multiplier 35, which restores the original stereo output of the adder 17 as will be described. The cos $\omega$ t signal from the VCO 36 is shifted ±45° in phase shifters 38 and 39 and fed to multipliers 40 and 41 as is the output of the corrector circuit 37. The multipliers 40 and 41 provide outputs of L and R plus DC terms.

Figure 4:
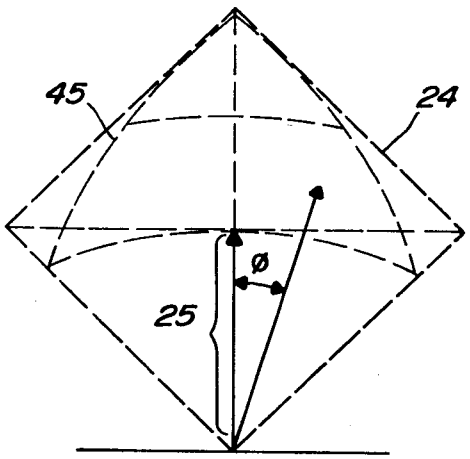
FIG. 4 is a phasor diagram representative of the transmitted signal in the system of FIG. 3.

FIG. 4, which is the phasor diagram for the transmitted signal in the system of FIG. 3, has a modified locus 45. Each point within the locus 45 corresponds to a point or value within the locus 24 multiplied by cos $\phi$. Multiplication by cos $\phi$ produces the minimum number of higher order sidebands consistent with the transmission of a compatible monophonic signal with minimum distortion.

Figures 4, 5:
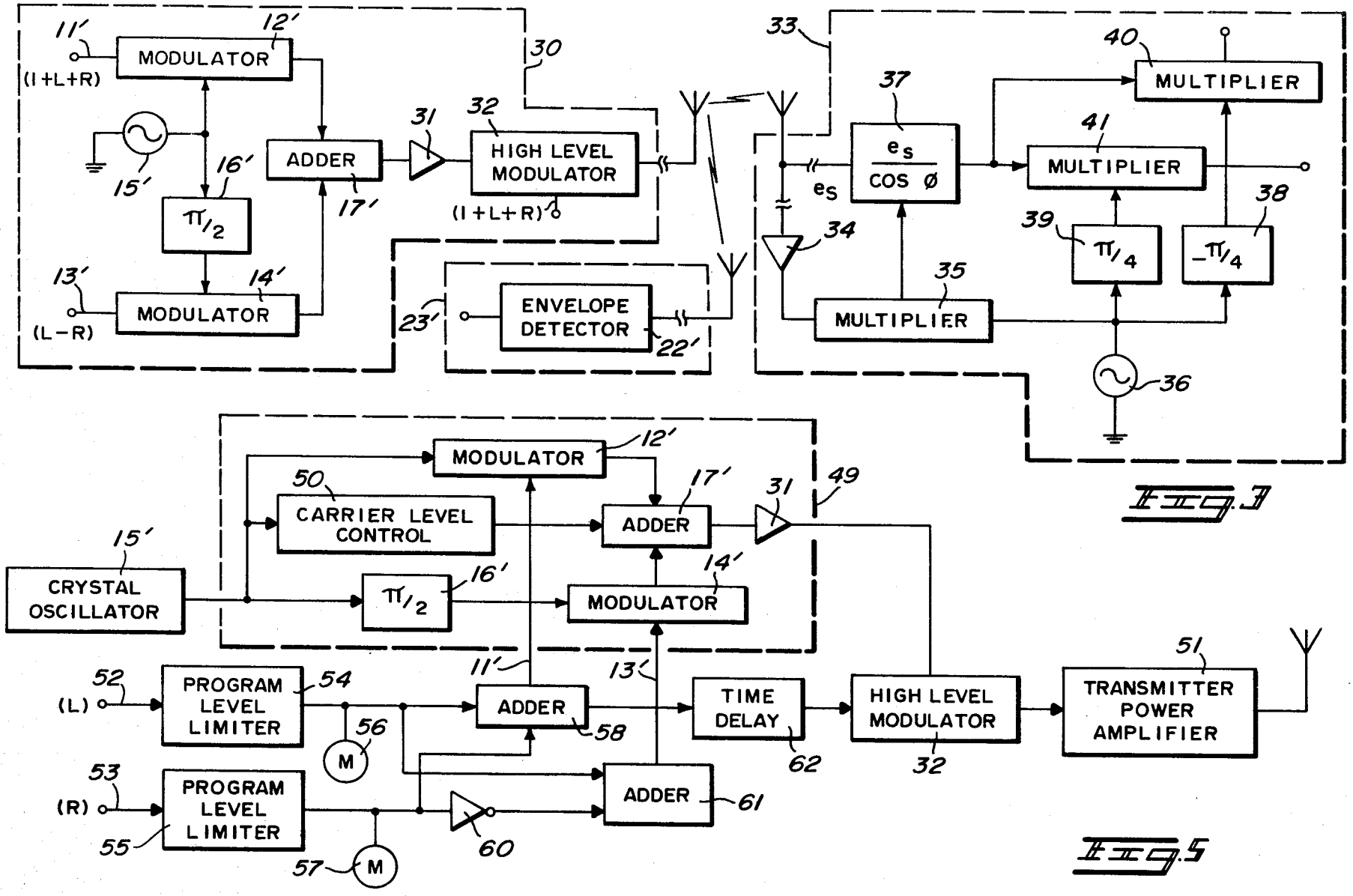
FIG. 5 is a block diagram of a transmitter compatible with the operational requirements of the invention.

In FIG. 5 the transmitter is shown in somewhat more detail. In a monaural transmitter, the carrier frequency from the crystal oscillator 15 would be coupled to the modulator 32. The necessary modifying circuits 49 for converting the oscillator output at this point, according to the invention are shown within the dashed line. The carrier frequency from the oscillator 15 is divided and one part is shifted 90° in the phase shifter 16. The two carriers in quadrature are then coupled to the modulators 12 and 14 and the modulator outputs are connected to the adder 17. A portion of the unshifted and unmodulated carrier is also connected to the adder 17 through a carrier level control 50 to establish the level of the unmodulated carrier. The adder 17 output is limited in limiter 31 to remove amplitude modulation, thereby leaving the carrier with the phase or stereo information only to be coupled to the high level modulator 32. Each of the program channel inputs 52 (L) and 53 (R) has a program level limiter 54 and 55 and a monitoring meter 56, 57. The L and R signals are combined (L+R) in the adder 58 which is connected to the multiplier 12. The R signal is inverted by the inverter 60 and combined (L−R) in the adder 61 which is connected to multiplier 14. A second output of the (L+R) adder 58 is connected through a time delay circuit 62 to the high level modulator 32. The time delay 62 provides a delay equal to that of the modifying circuits 49. The output of the modulator 32 is then a signal which is amplitude modulated with (L+R) information and phase modulated with the stereo information.

Figure 6:
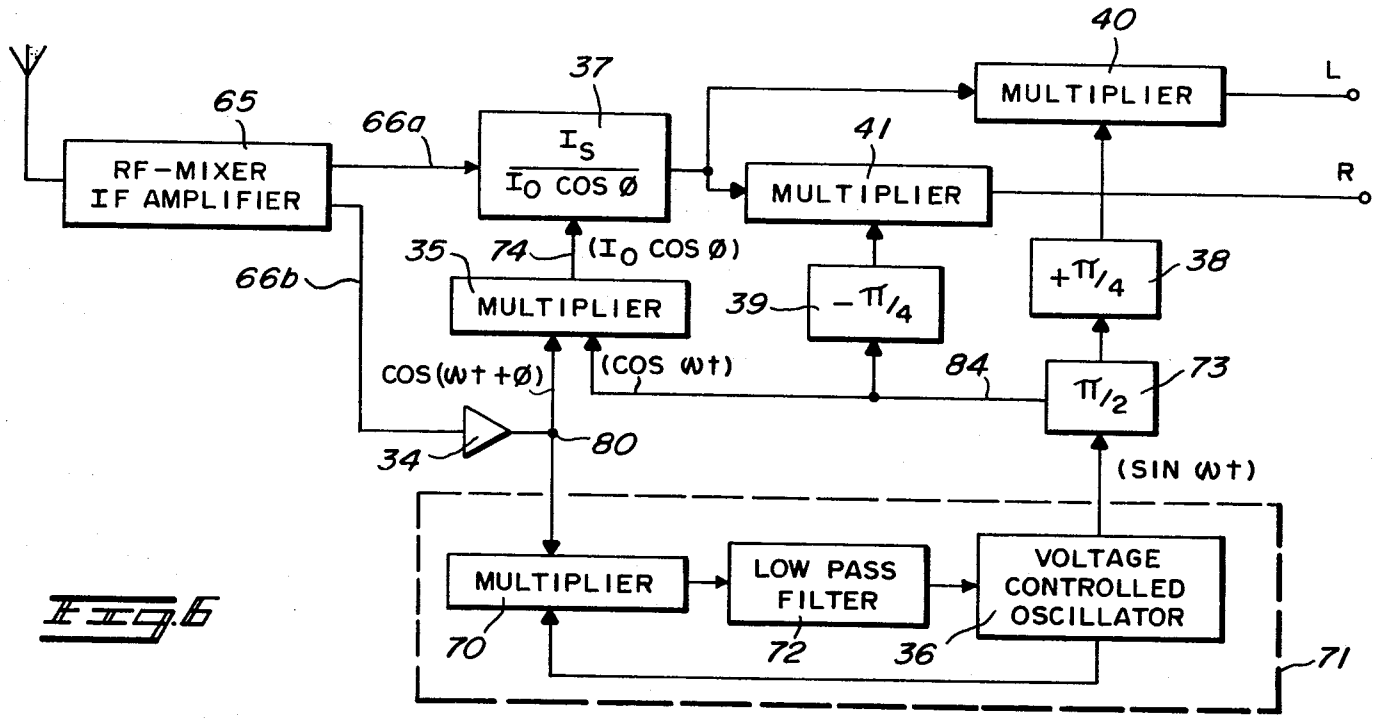
FIG. 6 is a block diagram of a preferred embodiment of a receiver compatible with the operational requirements of the present invention.

FIG. 6 shows the stereo receiver 33 of FIG. 3 in somewhat more detail. The received signal passes through an RF-mixer-IF amplifier section 65 and, except for the capability of detecting a somewhat greater bandwidth, the design thereof may be considered conventional and will be appreciated by those skilled in the art without further operational description. The amplitude modulation on the signal at the output **66*b* of the section 65 is removed in the limiter 34. The output of the limiter 34, which may be represented as cos ($\omega$t+$\phi$) is applied to one input of the in-phase detector or multiplier 35 and also to one input of a quadrature detector or multiplier 70. The multiplier 70 forms an integral part of a phase locked loop identified at 71. A low pass filter 72 prevents rapid phase changes from reaching a VCO 36 while allowing phase drift to pass through. The output of the VCO, then, is controlled very closely and, since it is in quadrature to the transmitter oscillator 15, it is coupled to a $\pi/2$ or 90° phase shifter 73. The resultant cos $\omega$ t output of the phase shifter 73 is connected to a second input of the multiplier 35. The output 74 of the multiplier 35 which may be represented as $I_o \cos \phi$ is coupled to the corrector circuit 37. In the corrector circuit 37, an embodiment of which is shown in detail in FIG. 7, the signal appearing at 66a is divided by the output of the multiplier 35, thus restoring the quadrature signal. The remainder of the circuit is substantially as described with regard to FIG. 3**.

In FIG. 7, an embodiment of a portion of the receiver 33 is depicted which will satisfactorily provide the above-described functions of the multiplier 35 and the corrector circuit 36. The phase detector or multiplier 35 receives an input from the limiter 34 on terminal 80. The limiter output switches a differential pair of transistors 81 and 82 in alternately conductive states in synchronism with the incoming carrier signal from the limiter 34. A reference input signal at terminal 84, derived from the phase locked loop 71, is supplied to the transistor or current source 83 by the output of the phase shifter 73. The phase shifter 73 also serves as a low pass filter, providing an essentially sinusoidal reference current to the transistor 83. A DC reference voltage at point 85 is supplied by an emitter follower 88 which is coupled to the differential pair 81, 82. A current mirror 87 balances out any static current from transistor 83 at the differential pair output 74, so that the output current is proportional to the cosine of the angular difference between the input signals 80 and 84. An integrating capacitor 86 smoothes the current impulses from the multiplier 35.

In order that the multiplier output 74 follow closely a cosine function, one of the inputs 80 or 84 must be relatively free of higher order harmonics. By making the phase shifting network 73 a low pass filter, odd order harmonics from the oscillator's square wave are removed.

The corrector circuit 37 preferably consists of a differential amplifier having a pair of transistors 100 and 101. Current for the emitters of transistors 100 and 101 is supplied by a current source 102. Two transistors 103 and 104 form a current mirror so that the current in the transistor 104 is equal to the current in transistor 100. When the currents in transistors 100 and 101 are equal, the current in the transistor 104 equals the current in the transistor 101 and the current $I_o$ is zero.

The signal voltage derived from the signal input 66a is applied between the bases of the transistors 100 and 101 respectively through two resistors 108 and 109, two diodes 110 and 111 and a reference voltage source 112. The reference voltage source 112 consists of an emitter follower 113 coupled to a voltage divider means consisting of three resistors 114, 115 and 116. The base of the transistor 113 is connected to the junction of the resistors 114 and 115 to provide a reference voltage. The emitter of the emitter follower 113 provides a low impedance voltage reference for the pair of transistors 100 and 101 forming the differential amplifier.

A current $I_r$ from the output terminal 74 of the multiplier 35 flows through the diodes 110 and 111, the resistors 108 and 109, the voltage source 112 and the input signal source 66a to provide forward bias for the diodes 110 and 111.

The forward impedance of the diodes 110 and 111, together with resistors 108 and 109, provide a voltage divider so that the voltage applied between the base of the transistor 100 and the base of transistor 101 is reduced by the ratio of the forward resistance of diodes 110 and 111 to the resistors 108 and 109.

The corrector circuit 37 will now be described in terms of its currents and the output of the multiplier 35, $I_r = I_{max} \cos \phi$. The output current may be represented by $I_o = I_l I_s / I_r$, where $I_l$ is supplied by a current source 102. $I_s$ is the input signal current at terminal 66a and may be represented as $e_s/2r$ where 2r equals the sum of the two resistors 108, 109 which are large value resistors. $e_s$ may be taken as equal to $e_c(1+L+R) \cos (\omega t+\phi)$, where $e_c$ is the amplitude of the unmodulated carrier. $I_{max}$ is the peak signal current in the transistor 83. Therefore $I_2 = [Ie_c(1+L+R) \cos (\omega_c t+\phi)]/2r$, and $I_o = [I_l e_c(1+L+R) \cos \omega_c t+\phi)]/2rI_{max} \cos \phi$. Since $$\cos \phi = (1 + L + R)/\sqrt{(1 + L + R)^2 + (L - R)^2},$$

$$I_o = (I_1 e_c/2rI_{max})\sqrt{(1 + L + R)^2 + (L - R)^2} \cos(\omega_c t + \phi)$$

which is the desired quadrature signal.

Figure 8:
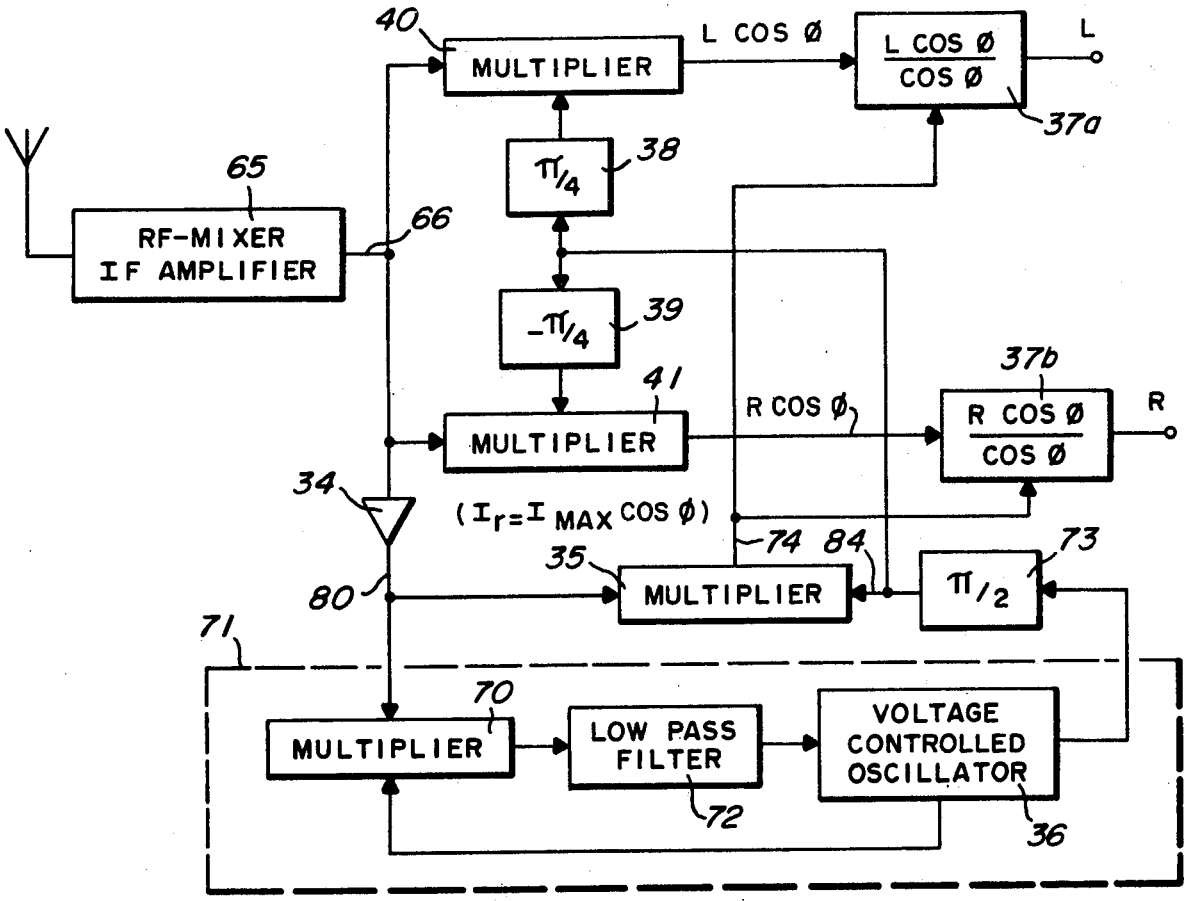
FIG. 8 is a block diagram of still another receiver compatible with the system of the present invention.

FIG. 8 shows a portion of another embodiment of a receiver compatible with the operational requirements of the present invention, wherein the corrector circuit 37 is in the audio portion of the receiver, and is, the fact, two identical corrector circuits 37a and 37b. The output 66 of the RF-mixer-IF amplifier 65 can now be a single output connected to multipliers 40 and 41. The output of the multiplier 40 is L cos $\phi$ and goes to corrector circuit 37a where it is divided by cos $\phi$ providing an L output. The output of multiplier 41 is R cos $\phi$ and is connected to the corrector circuit 37b where it is divided by cos $\phi$ providing an R output. The output current at point 74 of the multiplier 35 is divided and applied to both correctors 37a and 37b.

FIG. 9 shows still another receiver embodiment similar to those of FIGS. 7 and 8. Here the corrector circuit 37c has inputs 84 and 74 from the phase shifter 73 and the multiplier 35 respectively. The output 95 of the corrector circuit 37c is connected to the inputs of the phase shifters 38 and 39 and is the reference voltage from VCO 36 divided by cos $\phi$. The outputs of the multipliers 40 and 41 thus become L and R respectively.

FIG. 10 is a block diagram of a left-right SSB system having a transmitter similar to that of FIG. 5, that is, a quadrature system with the cos $\phi$ change. The L and R inputs are combined additively in adder 58 and subtractively in adder 61. The output of adder 61 is then phase shifted 90° in phase shifter 95 and fed to the transmitter as before. The required stereo receiver would have the decoding angles changed to derive outputs (L+R) such as indicated at 96 and (L−R) $\angle \pi/2$ such as indicated at 97. The output 97 is phase shifted by $-\pi/2$ in a phase shifter 98 and the output connected to receiver matrix 99 as is the output 96. The output of the matrix 99 is, of course, L and R.

FIG. 11 shows a detail of the receiver of FIG. 10, wherein the corrector circuit 37 is connected to the output 66 of the receiver RF-mixer-IF amplifier 65, the output of the corrector 37 is coupled to the multipliers 40 and 41 and the phase locked loop and phase shifting networks are the same as described with regard to FIG. 6. As described above with regard to FIG. 10 the one output 97 is phase shifted in phase shifter 98 and both outputs go to a matrix circuit 99 to provide L and R outputs.

Figure 12:
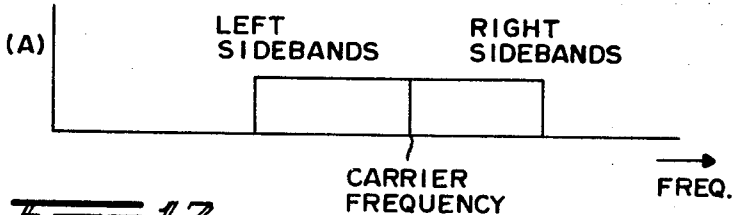
FIG. 12 is a spectrum diagram for the transmitted signal of FIG. 10.

FIG. 12 is a spectrum diagram showing that in the transmitted signal of FIG. 10 the L signals are contained in one set of sidebands and the R signals in the other set of sidebands. The signal, of course, also includes higher order correction sidebands which are transmitted double sideband.

Figure 13:
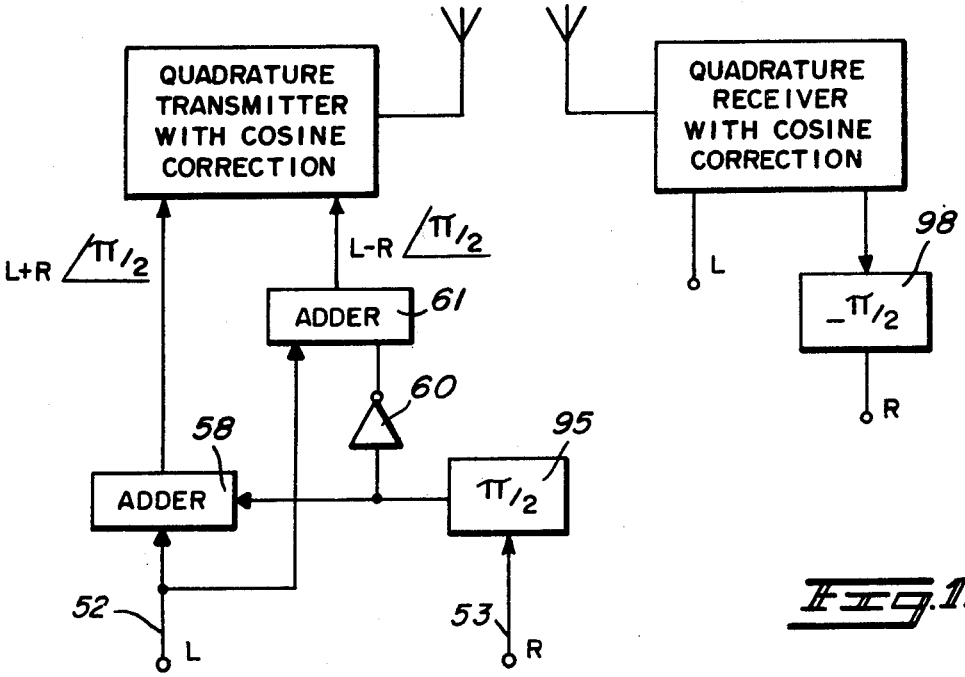
FIG. 13 is a block diagram of another SSB system.

FIG. 13 is a block diagram of another single sideband system similar to that of FIG. 10. In this embodiment one of the program input signals, e.g., R, is phase shifted by 90° in phase shifter 95. The phase shifted signal then goes to adder 58 and inverter 60, thence to adder 61. The second program signal, e.g., L, goes directly to adders 58 and 61. The outputs of the adders 58 and 61 are $(L+R\angle\pi/2)$ and $(L-R\angle\pi/2)$ respectively. These signals are modulated on to the carrier as before in the transmitter having the cosine correction. When received by a quadrature receiver with cosine correction, the corrected signals come out as L and $R\angle\pi/2$ and the R signal is shifted 90° lagging the phase shifter 98.

Figure 14:
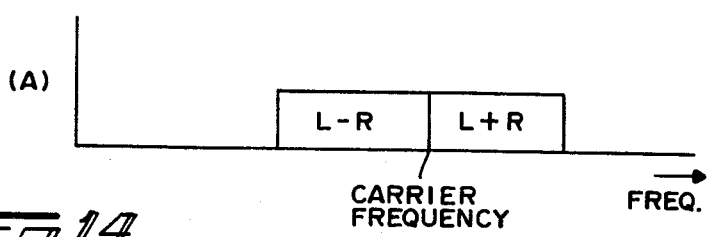
FIG. 14 is a spectrum diagram for the transmitted signal of FIG. 13.

FIG. 14 is a spectrum diagram of the transmitted signal showing that the sum and difference signals are transmitted single sideband and the correction information is transmitted double sideband.

Thus, by multiplying a quadrature signal by the cosine of an angle $\phi$ before transmission and dividing by the same cosine in the receiver, the system provides a signal which is completely compatible in monophonic receivers and easily decoded in stereophonic receivers, $\phi$ being defined as the angle between the vector sum of the initial quadrature carriers and a line that bisects the angle between the two quadrature carriers. The signal as transmitted has all of the advantages of quadrature modulation without causing distortion in an envelope detector. It provides a minimum of monphonic coverage loss due to skywave distortion and, at the same time, optimum stereo performance. The system is compatible with monophonic receivers using either envelope detection or synchronous detection. For best performance with synchronous detectors a corrector circuit is desirable but reasonable performance can be obtained by an unmodified synchronous receiver.

What is claimed is:

1. A communication system wherein signal information corresponding to first and second intelligence signals is transmitted in quadrature and is compatible for both monophonic and stereophonic operation, comprising in combination:

transmitter means for generating a single carrier wave amplitude modulated in accordance with the algebraic addition of said first and second intelligence signals and phase modulated by an angle whose tangent is the ratio of the difference between the first and second intelligence signals to the envelope of the amplitude modulated carrier, said carrier wave being fully compatible for reception and direct monophonic reproduction without substantial distortion, and receiver means for receiving said carrier wave and demodulating said first and second intelligence signals in quadrature for stereophonic operation.

2. The system according to claim 1 wherein the transmitter means comprises:

a first intelligence signal source;

a second signal intelligence ource;

a carrier wave source;

first combining means for combining additively the first and second intelligence signals;

second combining means for combining subtractively the first and second intelligence signals;

means for amplitude modulating the carrier wave in quadrature in response to the outputs of the first and second combining means;

means for limiting the amplitude of the modulated carrier wave; and means for amplitude modulating the limited carrier wave in response to the carrier output of the first combining means.

3. The system according to claim 1 wherein the transmitter means comprises:

a first intelligence signal source;

a second intelligence signal source;

a carrier wave source;

first combining means for combining additively the first and second intelligence signals;

second combining means for combining subtractively the first and second intelligence signals;

phase shifting means coupled to receive the outputs of at least one of the first and second combining means for shifting the phase of at least one of said outputs and for providing a 90° phase difference between said outputs;

means for amplitude modulating the carrier wave in quadrature in response to the outputs of the phase shifting means; means for limiting the amplitude of the modulated carrier wave;

means for amplitude modulating the limited carrier wave in response to the output of the first combining means; and wherein the receiver means includes phase shifting means for restoring the original phase relationship of the outputs of the first and second combining means of the transmitter means.

4. The system according to claim 1 wherein the transmitting means comprises:

a first intelligence signal source;

a second intelligence signal source;

a carrier wave source;

phase shifting means coupled to receive at least one of the first and second intelligence signals for shifting the phase of at least one of said intelligence signals to provide a 90° phase difference between said intelligence signals;

first combining means for combining additively the outputs of the phase shifting means;

second combining means for combining subtractively the outputs of the phase shifting means;

means for amplitude modulating the carrier wave in response to the outputs of the first and second combining means;

means for limiting the amplitude of the modulated carrier wave;

means for amplitude modulating the limited carrier wave in response to the output of the first combining means; and wherein the receiver means further includes phase shifting means for restoring the original phase relationship of the first and second intelligence signals.

5. A system for transmitting and receiving first (A) and second (B) intelligence signals on a single carrier wave, the system including in combination;

transmitter means for providing the carrier wave which is amplitude modulated with a signal proportional to (A+B) and phase modulated with a signal proportional to an angle $\phi$ having the form $$\phi = \text{arc tan } \{C_1(A-B)/(C_2+A+B)\}$$

where $C_1$ and $C_2$ are constants; and receiver means for receiving the transmitted signal and including means for separately deriving the first (A) and second (B) intelligence signals from the received signal.

6. The system according to claim 5 wherein the transmitter means includes a carrier wave source, first and second intelligence signal sources, first and second adder means for providing sum and difference signals in response to the outputs of the intelligence signal sources, means for amplitude modulating the carrier wave with the sum signal, and means for phase modulating the carrier wave with the signal proportional to the angle $\phi$.

7. The system according to claim 5 wherein the transmitter means comprises a first intelligence signal source, a second intelligence signal source, a carrier wave source, first combining means for combining additively and first and second intelligence signals, second combining means for combining subtractively the first and second intelligence signals, means for amplitude modulating the carrier wave in quadrature in response to the outputs of the first and second combining means, means for limiting the amplitude of the modulated carrier wave, and means for amplitude modulating the limited carrier wave in response to the output of the first combining means.

8. The system according to claim 5 wherein the deriving means comprises means for dividing the received signal by said signal proportional to the angle $\phi$.

9. The system according to claim 8 wherein said signal proportional to the angle $\phi$ is proportional to the cosine of the angle $\phi$.

10. The system according to claim 8 wherein the receiver means further includes oscillator means, limiter means for limiting a signal proportional to the received signal, first multiplier means for receiving the outputs of the oscillator means and the limiter means and for providing an output to the deriving means.

11. The system according to claim 10 wherein the receiver means further includes first phase shifting means connected to shift the output of the oscillator means by 45°, second multiplier means for receiving and multiplying the outputs of the first phase shifting means and the deriving means, second phase shifting means connected to shift the output of the oscillator means by −45°, and third multiplier means for receiving and multiplying the outputs of the second phase shifting means and deriving means.

12. A system according to claim 5 wherein the receiver means includes circuit means for providing a signal in response to the received signal and the deriving means includes means for dividing said responsive signal by a signal proportional to an angle $\phi$ having the form $$\phi = \arctan \{C_1(A-B)/(C_2+A+B)\}$$

where $C_1$ and $C_2$ are constants.

13. A system according to claim 5 wherein the receiver means includes input means for providing a signal in response to the received signal and the deriving means includes corrector means coupled to receive the responsive signal for providing substantially the first and second intelligence signals.

14. A system according to claim 13 wherein the input means comprises RF circuit means and the corrector means is coupled to the RF circuit means.

15. A system according to claim 13 wherein the input means includes IF amplifier means and the corrector means is coupled to the IF amplifier means.

16. A system according to claim 13 wherein the receiver means includes means for providing first and second audio signals proportional to the first (A) and second (B) intelligence signals, and the corrector means is coupled to receive said first and second audio signals.

17. A receiver for receiving a broadcast carrier wave which is amplitude modulated with signal information porportional to the sum of first (A) and second (B) intelligence signals, and which is phase modulated with the signal information proportional to an angle $\phi$ having a form $$\phi = \arctan \{C_1(A-B)/(C_2+A+B)\}$$

where $C_1$ and $C_2$ are constants, the receiver comprising:

input means for receiving and amplifying the broadcast carrier wave;

mixer means for translating the broadcast carrier wave to one of an intermediate frequency;

intermediate frequency amplifier means for amplifying said intermediate frequency carrier signal and having a bandwidth sufficient to accommodate said amplitude and phase modulation information; and correcting and demodulating means coupled to the amplifier means for providing a correction signal proportional to the angle $\phi$ and further employing sid correction signal to process a signal at the output of said amplifier means to provide signals essentially equal to the first and second intelligence signals.

18. The receiver according to clam 17 wherein the correcting and demodulating means comprises means for dividing said amplifier means output signal by said signal proportional to the angle $\phi$.

19. The receiver according to claim 18 wherein said signal proportional to the angle $\phi$ is proportional to the cosine of the angle $\phi$.

20. The receiver according to claim 18 wherein the receiver further includes oscillator means, limiter means for limiting a signal proportional to said amplifier means output signal, first multiplier means for receiving the outputs of said oscillator means and said limiter means and for providing an output to the correcting and demodulating means.

21. The receiver according to claim 20 wherein said correcting and demodulating means comprising a corrector means and a demodulator means, said demodulator means comprising second and third multiplier means and the receiver means further includes first phase shifting means connected to shift the output of the oscillator means by 45°, said second multiplier means receiving and multiplying the outputs of the first phase shifting means and the corrector means, second phase shifting means connected to shift the output of the oscillator means by −45°, and said third multiplier means receiving and multiplying the outputs of the second phase shifting means and the corrector means.

22. In an AM broadcast system, transmitter means for generating and transmitting a single carrier wave signal representative of first and second intelligence signals in quadrature relation and which is compatible for both monophonic and stereophonic operation, comprising in combination:

means for generating an unmodulated carrier wave signal of predetermined frequency;

means for amplitude modulating said carrier wave with the vector sum of the first and second intelligence signals;

phase shifter means coupled to the generating means for providing a second unmodulated carrier wave signl of the predetermined frequency and of a phase different from the first carrier wave signal;

means for amplitude modulating said second unmodulated carrier wave signal with the difference of the first and second intelligence signals;

adder means for combining the modulated first and second carrier waves;

means for limiting the amplitude variation of said combined carrier wave to a predetermined value to provide a signal having only the phase variation due to the combined first and second carrier waves; and means for amplitude modulating the limited carrier wave signal with the sum of the first and second intelligence signals.

23. A receiver for receiving a carrier wave which is amplitude modulated with a signal proportional to the sum of first (A) and second (B) intelligence signals, and which is phase modulated with a signal proportional to an angle $\phi$ having a form $$\phi = \text{arc tan } \{C_1(A-B)/(C_2+A+B)\}$$

where $C_1$ and $C_2$ are constants, the receiver comprising in combination:

means for selectively receiving the modulated carrier wave;

means for translating the received carrier wave to an intermediate frequency signal;

means for demodulating the intermediate frequency carrier wave to provide a first audio frequency signal proportional in amplitude to the product of the first intelligence signal and a function of the phase of said carrier wave, and a second audio frequency signal proportional in amplitude to the product of the second intelligence signal and a function of the phase of the said carrier wave; and corrector means adapted to divide each of the first and second audio frequency signals by a signal proportional to said function of the phase of the said carrier wave, for providing the first and second intelligence signals.

24. A transmitter for generating and transmitting a broadcast carrier wave amplitude modulated with the algebraic addition of first and second intelligence signals and phase modulated by an instantaneous angle whose tangent is the ratio of the difference between the first and second intelligence signals to the envelope of the amplitude modulated carrier, said transmitter including in combination:

circuit means for generating an unmodulated carrier wave of a predetermined frequency;

means for amplitude modulating said unmodulated carrier wave with the algebraic addition of the first and second intelligence signals;

means for changing the phase of said unmodulated carrier wave and amplitude modulating the phase-shifted carrier with the difference of the first and second intelligence signals;

adder and limiter means for combining said amplitude modulated carrier waves and limiting the amplitude variation thereof to a carrier wave having only phase variation;

high level modulation means for amplitude modulating said limited and phase varying carrier wave with the algebraic addition of the first and second intelligence signals; and means for transmitting said amplitude and phase modulated carrier wave.

25. A transmitter for generating and transmitting a broadcast carrier wave which is amplitude modulated with signal information proportional to the sum of the first (A) and second (B) intelligence signals, and phase modulated with signal information proportional to an angle $\phi$ having a form $$\phi = \text{are tan } \{C_1(A-B)/(C_2+A+B)\}$$

where $C_1$ and $C_2$ are constants, the transmitter comprising in combination:

means for providing a carrier wave of a predetermined frequency which is amplitude modulated by the sum of the first and second intelligence signals;

means for providing another carrier wave of said predetermined frequency but differing in phase and which is amplitude modulated by the difference of the first and second intelligence signals;

means for combining said amplitude modulated carriers and limiting the combined carriers to provide resultant signal information having only phase variation; and means for amplitude modulating said resultant phase varying carrier signal with the sum of the first and second intelligence signals.

26. A transmitter for generating and transmitting a broadcast carrier wave which is amplitude modulated with signal information proportional to the sum of first (A), shifted in phase by 90°, and second (B) intelligence signals, and phase modulated with signal information proportional to an angle $\phi$ having a form $$\phi = \text{arc tan } \{C_1(A\angle\pi/2-B)/(C_2+A\angle\pi/2+B)\}$$

where $C_1$ and $C_2$ are constants, the transmitter comprising in combination:

means for providing a carrier wave of a predetermined frequency which is amplitude modulated by the sum of the first and second intelligence signals;

means for providing another carrier wave of said predetermined frequency but differing in phase and which in amplitude modulated by the difference of the first and second intelligence signals;

means for combining said amplitude modulated carriers and limiting the same to provide a resultant signal information having only phase variation; and means for amplitude modulating said resultant phase varying carrier signal with the sum of the first and second intelligence signals.

27. A transmitter for generating and transmitting a broadcast carrier wave which is amplitude modulated with signal information proportional to the sum of first (A) and second (B) intelligence signals, and phase modulated with signal information proportional to an angle $\phi$ having a form $$\phi = \text{arc tan } \{C_1(A-B)\angle\pi/2/(C_2+A+B)\}$$

where $C_1$ and $C_2$ are constants, the transmitter comprising in combination:

means for providing a carrier wave of a predetermined frequency which is amplitude modulated by the sum of the first and second intelligence signals;

means for providing another carrier wave of said predetermined frequency but differing in phase and which is amplitude modulated by the difference of the first and second intelligence signals said difference being shifted in phase by 90°;

means for combining said amplitude modulated carriers and limiting the combined carriers to provide resultant signal information having only phase variation; and means for amplitude modulating said resultant phase varying carrier signal with the sum of the first and second intelligence signals.

28. A transmitter for generating and transmitting a single carrier wave signal representative of first (L) and second (R) intelligence signals in quadrature and which is compatible for both monophonic and stereophonic operation, said transmitter including in combination:

a first intelligence signal source;

a second intelligence signal source;

a carrier wave source;

first combining means for combining additively said first and second intelligence signals;

second combining means for combining subtractively said first and second intelligence signals;

means for separately amplitude modulating said carrier wave in quadrature in response to the outputs of said first and second combining means;

means for limiting the amplitude of the modulated carrier wave to provide a signal having phase modulation proportional to arc tan $\{(L-R)/(1+L+R)\}$; and means for amplitude modulating said limited carrier wave in response to the output of said first combining means.

29. A method of transmitting and receiving signal information representative of first and second intelligence signals in quadrature relation and which is compatible for both monophonic and stereophonic operation, comprising the steps of:

providing a first unmodulated carrier wave signal of a predetermined frequency;

amplitude modulating said first carrier wave signal with the sum of the first and second intelligence signals;

providing a second unmodulated carrier wave signal of the predetermined frequency and of a phase different from the phase of the first carrier wave signal;

amplitude modulating said second carrier wave with the difference of the first and second intelligence signals;

combining said first and second modulated carrier wave signals;

limiting the amplitude variation of said combined carrier wave signal to a predetermined value to provide a signal having only phase modulation;

additively combining said first and second intelligence signals;

amplitude modulating the phase modulated and limited carrier wave signal with the combined first and second intelligence signals, said phase and amplitude modulated carrier wave being compatible for reception and direct monophonic reproduction of the signal information without substantial distortion;

receiving said phase and amplitude modulated carrier wave;

detecting the envelope of the received modulated carrier to provide the sum of the first and second intelligence signals;

dividing the received modulated carrier by a function of the phase modulation to provide the difference of the first and second intelligence signals; and processing the sum and difference signals to produce the first and second intelligence signals.

30. A method of transmitting signal information representative of first and second intelligence signals in quadrature relation and which is compatible for both monophonic and stereophonic operation, comprising the steps of:

providing a first unmodulated carrier wave signal of a predetermined frequency;

amplitude modulating said first carrier wave signal with the sum of the first and second intelligence signals;

providing a second unmodulated carrier wave signal of the predetermined frequency and of a phase different from the phase of the first carrier wave signal;

amplitude modulating said second carrier wave with the difference of the first and second intelligence signals;

combining said first and second modulated carrier wave signals;

limiting the amplitude variation of said combined carrier wave signal to a predetermined value to provide a signal having only the phase modulation due to the two amplitude modulated carrier signals;

additively combining said first and second intelligence signals for amplitude modulating the phase modulated and limited carrier wave signal; and said phase and amplitude modulated carrier wave being compatible for reception and direct monophonic reproduction of the signal information without substantial distortion.

31. A receiver for receiving a carrier wave which is amplitude modulated with signal information proportional to the sum of first (A) and second (B) intelligence signals, and which is phase modulated with signal information proportional to an angle $\phi$ having the form $$\phi = \text{arc tan}\ \{C_1(A-B)/(C_2+A+B)\}$$

where $C_1$ and $C_2$ are constants, the receiver comprising in combination:

input means for receiving and amplifying the carrier wave and having a bandwidth sufficient to accommodate said amplitude and phase modulation information;

first detector means coupled to the input means for detecting a signal proportional to L cos $\phi$;

second detector means coupled to the input means for detecting a signal proportional to R cos $\phi$; and transducer means for separately reproducing the first and second intelligence signals in relatively distortion-free form at low modulation levels.

32. A receiver in accordance with claim 31 wherein the input means includes means for translating the received carrier wave to one of an intermediate frequency.

33. A receiver for receiving a carrier wave which is amplitude modulated with a signal proportional to the sum of first (A) and second (B) intelligence signals, and which is phase modulated with a signal proportional to an angle $\phi$ having the form $$\phi = \text{arc tan } \{C_1(A-B)/(C_2+A+B)\}$$

where $C_1$ and $C_2$ are constants, the receiver comprising in combination:

input means for selectively receiving the modulated carrier wave;

means for translating the received carrier wave to an intermediate frequency carrier wave;

means for demodulating the intermediate frequency carrier wave to provide a first audio frequency signal proportional in amplitude to A cos $\phi$ and a second audio frequency proportional in amplitude to B cos $\phi$; and transducer means for separately reproducing first and second intelligence signals which are relatively distortion-free at low modulation levels.

34. A method of receiving stereophonic signal information of the form $(C_1+L+R)\cos(\omega_c t+\phi)$ where L and R are intelligence signals and $\phi$ is arc tan $\{C_2(L-R)/(C_1+L+R)\}$ where $C_1$ and $C_2$ are constants, and comprising the steps of:

selectively receiving and amplifying the transmitted signal;

detecting the signal L cos $\phi$ on the amplified signal;

detecting the signal R cos $\phi$ on the amplified signal;

coupling the L cos $\phi$ and R cos $\phi$ signals to audio transducer means for separate reproduction of L and R intelligence signals which are relatively distortion-free at low modulation levels.

35. The method of receiving stereophonic signal information in accordance with claim 34 and further including the step of translating the received and amplified signal to an intermediate frequency signal.

36. A method of receiving a signal of the form $(C_1+L+R)\cos(\omega_c t+\phi)$ where L and R are intelligence signals and $\phi$ is arc tan $\{C_2(L-R)/(C_1+L+R)\}$ where $C_1$ and $C_2$ are constants, and comprising the steps of:

selectively receiving the transmitted signal;

amplifying the received signal;

providing a reference oscillator having the frequency of the unmodulated broadcast carrier;

separately phase shifting the output signal of the reference oscillator by $\pi/4$ and by $-\pi/4$ to provide first and second oscillator signals respectively; and multiplying the amplified signal by the first and second oscillator signals respectively to provide signals which are substantially L and R at low modulation levels.

37. The method of receiving a signal in accordance with claim 36 and further including the steps of providing a second local oscillator having a frequency differing from the carrier frequency by a predetermined amount; and mixing the selectively received signal and the output signal of the second local oscillator to provide an intermediate frequency signal.

38. A receiver for receiving a broadcast carrier wave which is amplitude modulated with signal information proportional to the sum of first (A) and second (B) intelligence signals, and which is phase modulated with the signal information proportional to an angle $\phi$ having a form $$\phi = \text{arc tan } [C_1(A-B)/(C_2+A+B)]$$

where $C_1$ and $C_2$ are constants, the receiver comprising:

input means for receiving and amplifying the broadcast carrier wave;

mixer means for translating the broadcast carrier wave to one of an intermediate frequency;

intermediate frequency amplifier means for amplifying said intermediate frequency carrier signal and having a bandwidth sufficient to accommodate said amplitude and phase modulation information; and demodulator means coupled to the amplifier means for providing output signals substantially equal to the first and second intelligence signals.

* * * * *

UNITED STATES PATENT AND TRADEMARK OFFICE

CERTIFICATE OF CORRECTION

PATENT NO. : 4,218,586

DATED : August 19, 1980

INVENTOR(S) : Norman W. Parker and Francis H. Hilbert

It is certified that error appears in the above-identified patent and that said Letters Patent are hereby corrected as shown below:

In the Abstract, line 3, delete "monoaural" and insert --monaural--.

Column 3, line 19, delete "$\emptyset$ = arc tan$^{-}$(L - R)/(1 + L + R) and insert --$\emptyset$ = arc tan$^{-1}$(L - R)/(1 + L + R)--.

Column 3, line 59, before "(1 + L + R)/", insert --cos $\emptyset$:--.

Column 5, line 15, delete "36" and insert --37--.

Column 6, line 11, delete "($\omega$t + $\emptyset$)" and insert --($\omega_c$t + $\emptyset$)--.

Column 6, line 13, delete "$I_2$" and insert --$I_s$--.

Column 6, line 25, delete "the" (third use) and insert --in--.

Column 7, line 17, after "lagging", insert --in--.

Column 7, line 33, delete "monphonic" and insert --monophonic--.

Column 9, line 19, delete "and" (first use) and insert --the--.

Column 10, line 30, delete "sid" and insert --said--.

Column 10, line 34, delete "clam" and insert --claim--.

Column 11, line 6, delete "signl" and insert --signal--.

UNITED STATES PATENT AND TRADEMARK OFFICE

CERTIFICATE OF CORRECTION

PATENT NO. : 4,218,586

DATED : August 19, 1980

INVENTOR(S) : Norman W. Parker and Francis H. Hilbert

It is certified that error appears in the above-identified patent and that said Letters Patent are hereby corrected as shown below:

Column 12, line 15, delete "Ø = are tan" and insert --Ø = arc tan--.

Column 12, line 49, delete "in" and insert --is--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*